United States Patent [19]

Dickinson et al.

[11] Patent Number: 4,872,509

[45] Date of Patent: Oct. 10, 1989

[54] OIL WELL PRODUCTION SYSTEM USING A HOLLOW TUBE LINER

[75] Inventors: Ben W. O. Dickinson, San Francisco County; Robert W. Dickinson, Marin County; Randall R. Anderson, Solano; Eric W. Dickinson, Marin County; Robert D. Wilkes, Alameda County, all of Calif.

[73] Assignee: Petrolphysics Operators, San Francisco, Calif.

[21] Appl. No.: 155,361

[22] Filed: Feb. 12, 1988

Related U.S. Application Data

[63] Continuation-in-part of Ser. No. 811,572, Dec. 23, 1985, Pat. No. 4,750,561.

[51] Int. Cl.[4] ..... E21B 43/10

[52] U.S. Cl. ..... 166/278; 166/51

[58] Field of Search ..... 166/278, 50, 51, 55.1, 166/297, 384; 175/77, 79, 82

[56] References Cited

U.S. PATENT DOCUMENTS

| | | | |
|---|---|---|---|
| 2,749,988 | 6/1956 | West | 166/51 X |
| 2,778,603 | 1/1957 | McCune et al. | 166/278 X |
| 3,999,608 | 12/1976 | Smith | 166/51 X |
| 4,046,198 | 9/1977 | Gruesbeck et al. | 166/51 X |
| 4,526,230 | 7/1985 | Kojicic | 166/51 X |
| 4,532,994 | 8/1985 | Toma et al. | 166/278 X |

*Primary Examiner*—Thuy M. Bui

*Attorney, Agent, or Firm*—Flehr, Hohbach, Test, Albritton & Herbert

[57] ABSTRACT

A system for gravel packing a production radial tube terminating in an open drillhead in an oil bearing formation. The radial tube is perforated by an electrolytic perforation tool which is removed. A flexible permeable liner is passed into the radial tube and slurry is flowed through the liner and out the distal end to the radial tube back towards the well bore to the fill. Then, plug filters are placed at the proximal and distal ends of the radial tube which pass oil but not gravel, and the proximal end of the radial tube is severed, if desired.

29 Claims, 7 Drawing Sheets

OIL WELL PRODUCTION SYSTEM USING A HOLLOW TUBE LINER

CROSS-REFERENCE TO RELATED APPLICATIONS

This application is a continuation-in-part of copending application Ser. No. 811,572, filed Dec. 23, 1985, now U.S. Pat. No. 4,750,561. Reference is also made to Dickinson, et al. application Ser. No. 811,577, filed Dec. 23, 1985.

BACKGROUND OF THE INVENTION

This invention relates to earth well drilling systems. In particular, it relates to an oil well production system including one or more radial hollow tube liners extending into an earth formation from a well bore.

A number of techniques are known for passing a drill string down a well bore through a whipstock into adjacent underground formation. One particularly effective technique is disclosed in Dickinson et al. U.S. Pat. No. 4,527,639 wherein a piston-like system permits the turning of a rigid pipe drill string through a short radius 90 degree turn. This is accomplished by directing hydraulic fluid against the rearward side of a drillhead at the forward end of the drill string to provide a pulling force at the drillhead to move the pipe into the formation without buckling of the pipe. An improvement on this system is described in co-pending Dickinson et al. application Ser. No. 811,577, filed Dec. 23, 1985, wherein pushing forces at the rearward end of the drill string are used in addition to the pulling forces to move the rigid pipe through the whipstock and to control the rate of movement of the pipe.

Erectable whipstocks are known and described in Dickinson et al. U.S. Pat. No. 4,527,639 and in EPA Publication 0 100 230. There, a retractable whipstock consisting of connected assemblies are disclosed which extend from a retracted position within the structure to form an arcuate tube bending guideway by applying hydraulic forces from the surface to a hydraulic piston assembly. After placement of the production radial tube, it is severed near the whipstock, and the remaining drill string and whipstock may be withdrawn as by pulling from the surface. The procedure is repeated to place multiple radial tubes into other portions of the formation.

In Dickinson et al. U.S. Pat. No. 4,693,327, an improved retractable whipstock is disclosed which includes a structure with a number of collapsed, connecting guideway assemblies and a retractable anchor connected to the rear side of the anchor assembly. Erection means is provided which is slidable within the assembly and pivotally connected to a forward one of the guideway assemblies and at its other end to an extension member extending to the surface. When the system reaches the desired position adjacent the formation, the anchor is locked in the earth well and the erection means is pulled by an extension arm from the surface to cause a forward one of the guideway assemblies to be pivotally swung so that the guideway assemblies in composite form a curved pathway extending into the formation. .After erection, a drill string is passed through the whipstock into the formation and used as for steam injection. The radial tube is cut near the whipstock exit for production and portion of the tube and the whipstock is pulled back from the surface. The system also includes a deerection system in which the extension arm is again lowered to cause the guideway assemblies to move back into their retracted position. The anchor means is collapsed and the entire assembly may be moved to another position within the well or pulled to the surface. In this manner, multiple radial tubes may be placed into the formation.

Patent application Ser. No. 811,572 relates to a system of gravel packing which is particularly effective for gravel packing radials in conjunction with the above type of systems using multiple production radial tubes. Gravel packing is a technique whereby gravel is packed around a production well extending into an underground formation. The well typically is lined with a slotted liner which includes slots of a size sufficient to pass oil from the surrounding formation into the liner for pumping to the surface but small enough to screen out the gravel pack particles.

Various gravel packing techniques are disclosed in Zublin U.S. Pat. No. 2,434,239, Sparkin U.S. Reissue Pat. No. 28,372 and Medlin U.S. Pat. No. 4,378,845. Zublin discloses gravel packing of lateral pipes which are withdrawn during gravel packing. Medlin discloses gravel packing from a well through a lateral screen. Sparkin discloses gravel packing a well by pumping through casing perforations.

SUMMARY OF THE INVENTION

The present invention is directed primarily to a system for use in the recovery of oil from an oil-bearing formation. Specifically, the system includes one or more radial hollow tube liners extending from a well bore into the formation, preferably after placement by passage through a whipstock. As used herein, the terms "hollow tube liner" or "liner" refer to a tube which extends from the well head down the casing and into the formation. The liner includes openings of a size and character to pass oil from the formation into the liner but substantially block passage of formation particles. The tube will be described in more detail hereinafter.

In general, the production apparatus is formed by first passing a hollow radial tube, terminating in a drillhead, through the well casing and housing into the formation, using hydraulic drilling forces to move the radial tube to project a substantial distance into the formation. As used herein, the term "radial tube" refers to that portion of the drill string extending from the surface into the formation. In some instances, such radial tubes may be connected to the remainder of the drill string extending through the casing and well bore (termed the "the main drill string") during drilling.

In one embodiment, the hollow tube liner is passed through the radial tube and out into the formation simultaneously with the radial tube as by securing it in a releasable manner, such as a detachable coupling. In another embodiment, the liner is passed by propulsion through the radial tube after the radial tube is in formation.

After the liner is in place in the formation, the radial tube is withdrawn from the formation through the casing leaving the liner in place. Then, oil may be pumped from the formation to the surface in a conventional manner. In one embodiment, oil is withdrawn through the liner without gravel packing. In another embodiment, gravel packing is placed around the liner in a number of different techniques before or after the radial tube is withdrawn.

DETAILED DESCRIPTION OF THE PREFERRED EMBODIMENTS

Figure 1:
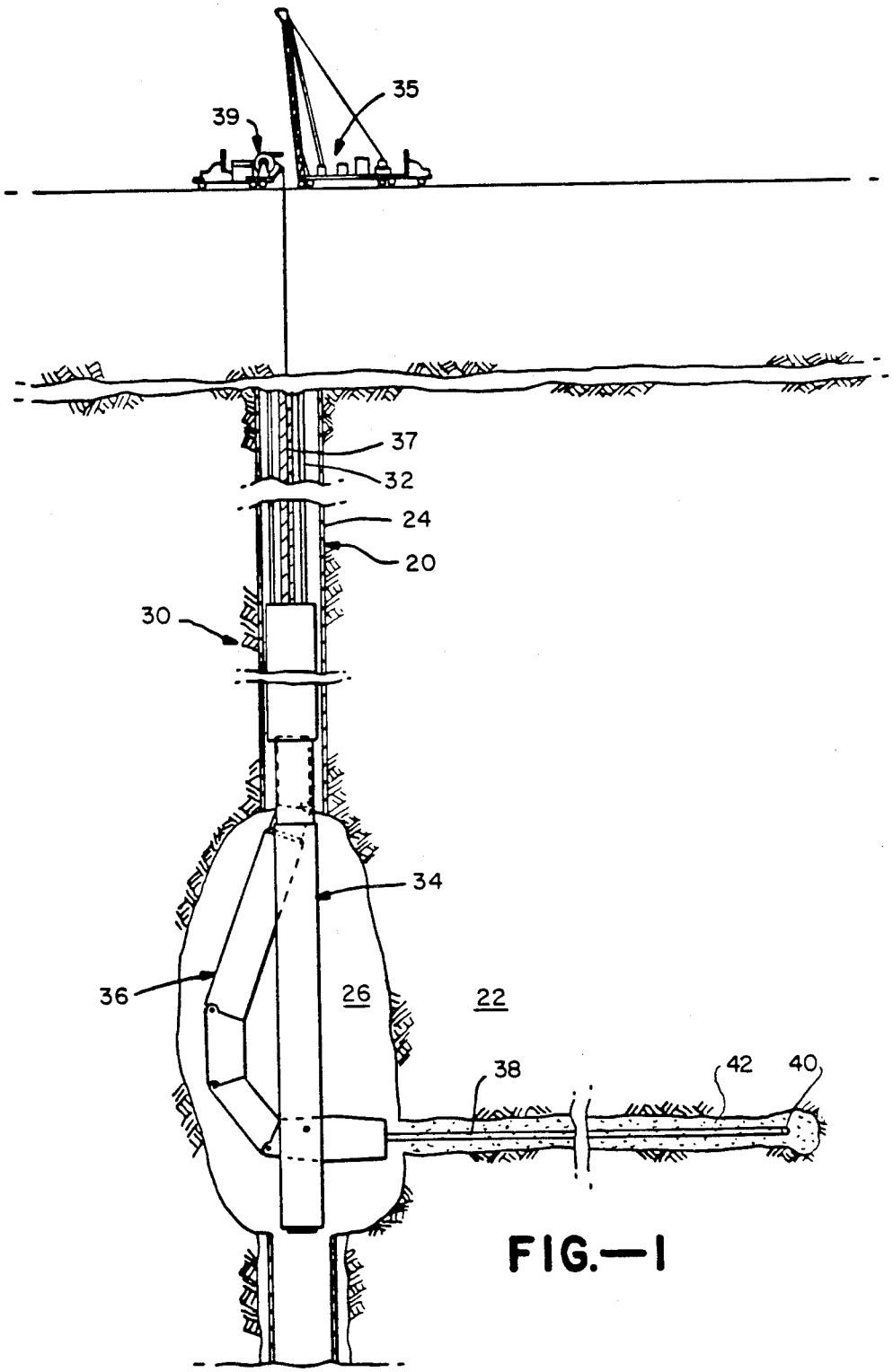
FIG. 1 is a side elevational view in section showing one type of drill system including a radial tube in the formation.

FIG. 1 schematically shows an earth well 20 which extends down to a target oil bearing formation 22. In this instance, the well is shown provided with a casing 24 which may extend down to an underreamed cavity 26 that is adjacent to the formation 22. Structure 30 includes piping 32 extending in the well consisting, in this instance, of a pipe string within which a drilling string is normally disposed. Structure 30 also includes housing 34 serving to carry whipstock means 36. Main drill string 37 passes through piping 32, whipstock means 36, and projects into the formation as radial tube 38 terminating in drillhead 40 including ports for passing drilling fluid into the formation. Main drill string 37 and radial tube 38 are, in composite, the drill string formed of a hollow rigid metal solid wall. FIG. 1 also schematically shows a production rig 35 of the mobile type and a reel carrying truck 39 which may carry a supply of drill string for use in the well that may be connected to the drill string during its placement.

The system of FIG. 1 illustrates a retractable whipstock capable of placing multiple radial pipes in a single well. Specifically, whipstock 36 passes through the well in a retracted position until it reaches the position in the well at which radial tube 38 is to be extended into the formation. Then, the whipstock is extended into its operable position, as illustrated in FIG. 1 and the tube is placed. The whipstock is suitably of the type illustrated in the aforementioned Dickinson et al U.S. Pat. No. 4,693,327. Alternatively, another type of whipstock, such as illustrated in U.S. Pat. No. 4,497,381, may be employed. A particularly effective system for placing radial tube 38 is by use of an assembly in which the drill string forms a piston sliding in a guide tube. Pressurized fluid flowing through the piston body applies pressure against the drillhead causing it to move into the formation at the same time as it is cutting a pathway for itself. A system of this type is described in U.S. Pat. No. 4,527,639. A modification of this system is described in the aforementioned Dickinson et al application Ser No. 811,577.

In the above system, during drilling, radial tube 38 passes through whipstock 36. Drilling fluid passes through the ports of drillhead 40 creating an annulus 42 between radial tube 38 and the surrounding formation. A feature of the invention is to provide an effective means of gravel packing of annulus 42.

Gravel packing constitutes the placement of particles in an oil permeable porous mass or jacket (termed "gravel pack") in a zone, such as annulus 42. The gravel pack passes oil while filtering out most of the particles in the surrounding formation. Such gravel, typically in a sieve size range of 6 to 40, is placed by passage to the desired area in a slurry form and laid down in that area. For example, it is well known to pack underreamed area 26 with gravel pack particles.

In general, gravel packing of horizontal bore holes is accomplished by flowing the slurry of particles, of appropriate size to form gravel pack, from within the well bore through the lumen of radial tube 38 and out openings in the distal end of the tube into annulus 42 and back toward the well bore to form a jacket of gravel pack in the annulus. After termination of gravel pack flow, water may be flowed through the radial tube at a pressure and for a time sufficient to remove the particles from the radial tube lumen.

Application Ser. No. 811,572, incorporated herein by reference, describes perforation of the radial tube after placement in the formation. The radial tube is perforated with multiple openings disposed towards the distal end through which the gravel pack slurry is flowed. Additional perforations are also disclosed as being formed at spaced intervals along the remaining length of radial tube 38.

Figure 2:
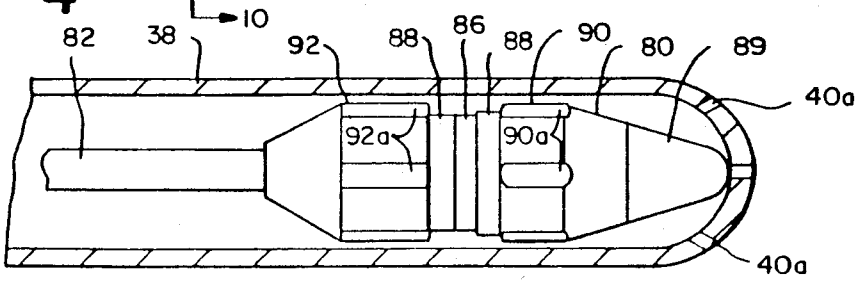
FIG. 2 is a side elevational view of a forward portion of a pipe cutting device disposed in a radial tube.

Referring to FIG. 2, an electrolytic pipe cutting device 80 is illustrated connected to an electric cable 82 which, in turn, is connected to the source of electrical power, not shown. Device 82 includes a nose cone 89 suitably formed of an impact resistant material such as nylon and an electrically conductive metal strip 86 electrically connected to cable 82. Cutting device 80 also includes ceramic rings 88 on both sides of metal strip 86 serving as insulators (heat sinks) to protect the tool body from heat and corrosion generated at strip 86 during cutting. Cutting device 80 also includes forward and rearward liquid channeling sections 90 and 92, respectively, with channels 90*a* and 92*a* respectively, serving to channel the flow of liquid passing ring 86.

In operation, the cutting device of FIG. 2 is pushed to a predetermined area of radial pipe 38 and an aqueous electrolytic solution, such as of potassium chloride, is pumped passed the cutting device 80 and out drillhead ports 40*a*. In the illustrated embodiment, the cutting device 80 is directed to the drillhead until nose portion 89 abuts the rearward side of the drillhead to position strip 6. Then, the electrolyte is directed passed strip 6 while a DC power source energizes the strip. An electrical circuit is completed between strip 86 and the adjacent wall of radial tube 38 and the radial tube is severed. As will be explained more fully hereinafter, after severing, pipe cutting device 80 is pulled out of radial tube 38. A surtable permeable filter device is placed proximal to the opening formed at the severed distal end of radial tube 38 of a type which blocks flow of formation particles into radial tube 38 while permitting the flow of oil. This may be accomplished simultaneously by use of a pipe cutting filter device assembly as shown in FIG. 3.

In order to deerect whipstock means 36 for placing other radial pipes into the formation, radial tube 38 may be pulled from the surface through the whipstock. Then, the main drill string 37 is pulled out of the well and the whipstock is repositioned at a desired location. For example, the whipstock may be left at the same elevation and rotated to a different radial position. Thereafter, another drill string is passed through the whipstock in the manner described above to form spokes projecting from the well axis.

In order to sever the distal end of radial tube 38, a cutting device 80 is positioned near the distal end of radial tube 38. The pipe is severed by passing current through the device while simultaneously flowing an electrolytic solution by it as described above. One way to precisely position the cutting device is to include a rigid bar as a portion of the flexible cable of a length such that it cannot make the full turn through the whipstock. The cutting device is positioned at a predetermined distance downstream from the rigid pipe so that it is near the distal end of radial tube 38. After cutting, cutting device 80 may be pulled to the surface through cable 2. Alternatively, it may be left in place by providing an automatic detachment such as an electric fuse device at the cable connection so that the cutter remains in place while the cable is pulled to the surface. This embodiment is more fully described with respect to FIG. 3.

Figure 3:
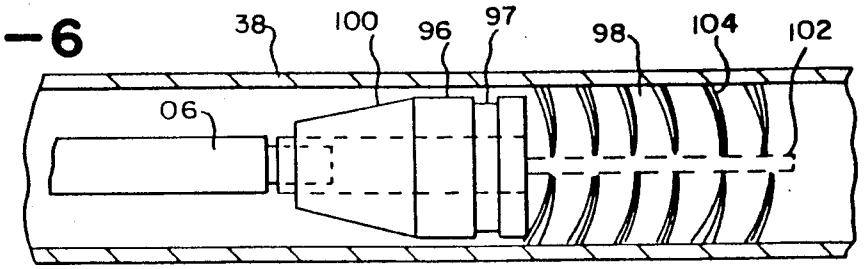
FIG. 3 is a side view of a combination porous plug filter and pipe cutter and disposed in a radial tube.

FIG. 3 illustrates an assembly 96 of permeable plug filter portion 98 and pipe cutting portion 100 disposed in radial tube 38. Plug filter portion 98 is constructed to be capable of substantially blocking gravel pack particle flow while passing fluids such as oil. As illustrated, it comprises a bottle brush-like permeable plug including a spine 102 and wire brushes 104 projecting radially from the axis of spine 102 which is mounted to the adjacent portion of pipe cutting portion 100. Further filtration means such as steel wool may be placed between turns of the wire brushes 104 to enhance filtering. Pipe cutting portion 100, including metal strip 97, may be constructed in the same manner as pipe cutting device 80 and interconnected to a suitable source of power through cable 106. Suitable detachment means, not shown, may be provided between cutting device portion 100 and plug filter means 98 for detachment, typically before severing of pipe 38 adjacent metal strip 97. Such detachment means may comprise an electric fuse or a detachable threaded connection or the like. After severing near the proximal end of radial tube 38, cutting device portion 100 may be withdrawn followed by a removal of main drill string 37 to permit deerection of the whipstock. Plug filter means portion 98 serves to maintain the interior of radial tube 38 essentially free of gravel pack or formation particles to permit the oil to flow freely through the radial tube. For this purpose, as illustrated, in FIG. 6, such plug filter means may be placed at both the distal and proximal ends of the radial tube in combination with a liner as described hereinafter.

Figure 4:
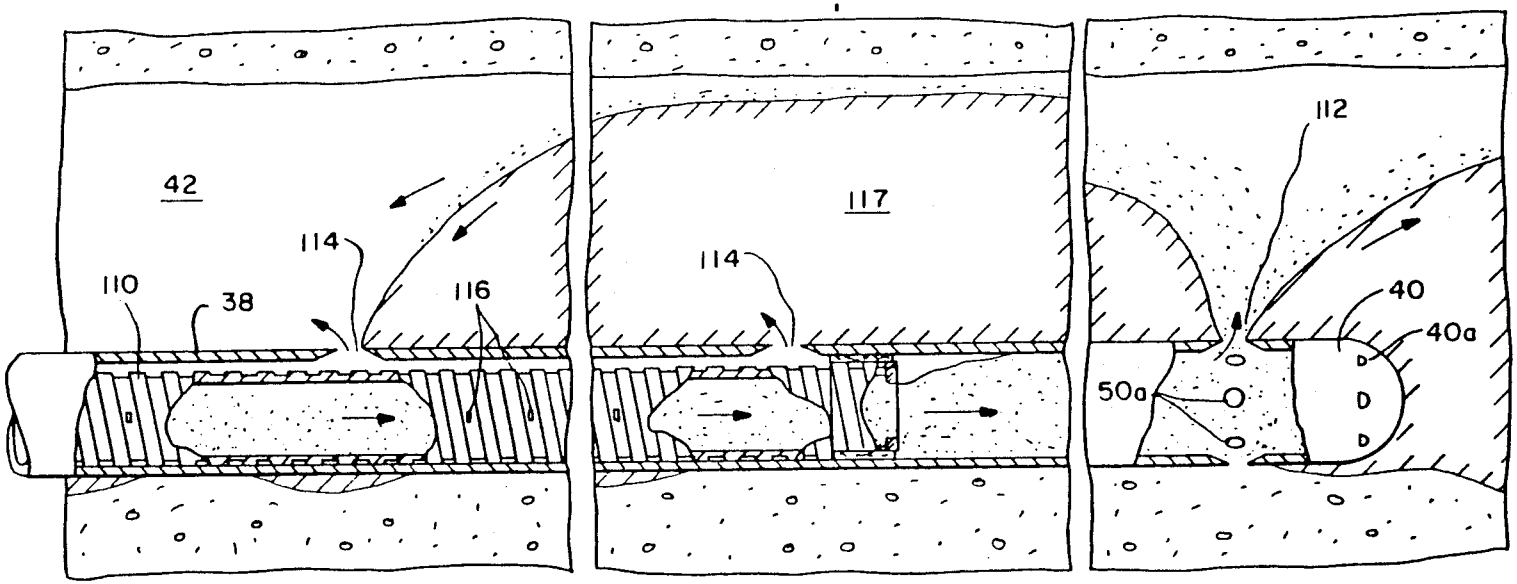
FIG. 4 is a side view of a radial tube partially broken away illustrating a liner for the radial tube, as disposed in the formation.
Figure 5:
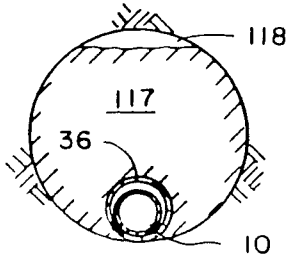
FIG. 5 is a cross section of FIG. 4 (line 5—5).

Referring to FIGS. 4 and 5, a radial tube 38 is illustrated in the formation with a porous, elongate, hollow tube liner 110 defining lumen 110*a* coaxially disposed within the radial tube. Radial tube 38 includes drillhead 40 with ports 40*a* and circumferentially spaced ports 112 disposed close to the drillhead. Ports 112 serve to permit the flow of gravel pack particles through the lumen of liner 110 during gravel packing. Radial tube 38 also includes ports 114 spaced longitudinally along the radial tube. Liner 110 is sufficiently flexible so that it may be passed through the curve of whipstock means 36 without undue friction. Liner 110 is also sufficiently permeable to liquid so that a portion of the water content of the slurry passing through lumen 110*a* of liner 110 passes out ports 40*a* into annulus 42. A suitable form of liner 110 to accomplish these objectives is conventional BX electrical conduit for electrical cable, typically formed of a metal spiral wound in a coil with spaces between adjacent coil segments. If desired to increase fluid porosity, additional ports such as slits 116 may be provided in the liner.

As set forth above, prior to placing radial tube 38, the formation adjacent the whipstock is underreamed and the whipstock is erected. Then, slotted liner 110 is placed. In one mode, a flexible piston may be placed on its nose, formed of a material such as Velcro or a chevron seal, so that it can be pumped down by passing fluid in the annulus between liner 110 and radial tube 38. Alternatively, liner 110 can be pushed down either by radial tubing and by an internal stiffener rod to provide sufficient rigidity to prevent collapse of the liner during placement. After placement, the internal stiffener rod may be removed. In either event, liner 110 is placed until the forward end abuts the rearward side of the drillhead. Then, gravel pack slurry is flowed through the liner and out ports 112 in a distal direction as shown by arrows A and then in a proximal direction in annulus 42 as shown by arrows B.

During passage through liner 110, the gravel is partially dewatered and increases in gravel concentration. A suitable initial concentration of gravel in the slurry is about 1–4 pounds per gallon which may be concentrated about 25–50% or higher during dewatering. Suitably, ports 112 near drillhead 40 are approximately twice the cross-sectional area of radial tube 38. This large area minimizes the pressure drop through the ports and thus the slurry velocity to avoid entrainment of the gravel pack in the formation. Otherwise, such entrainment could deleteriously affect the imprecisely sized interstices between the gravel grains thereby reducing the life of the gravel pack. The gravel flowing out ports 112 at such lower velocity than during drilling flows towards the well bore and forms a dune 117 because the gravel flow is below the slurrification velocity. The moving sand dune 117 fills up a portion of the annulus 42 and leaves an open area, referred to as an ullage 118, which is segment shaped with a relatively flat bottom and curved top. The face of the sand dune 117 gradually moves to fill up annulus 42 in the range of about 50–90% of the total cross-section of the annulus. As the dune 117 moves back towards the well 2bore, the water which passed through ports 114 reenters the slurry and tends to preclude sanding off or plugging of the slurry as the sand dune moves toward the well bore. FIG. 4 shows the sand dune 117 in transit prior to reaching the well bore.

Figure 6:
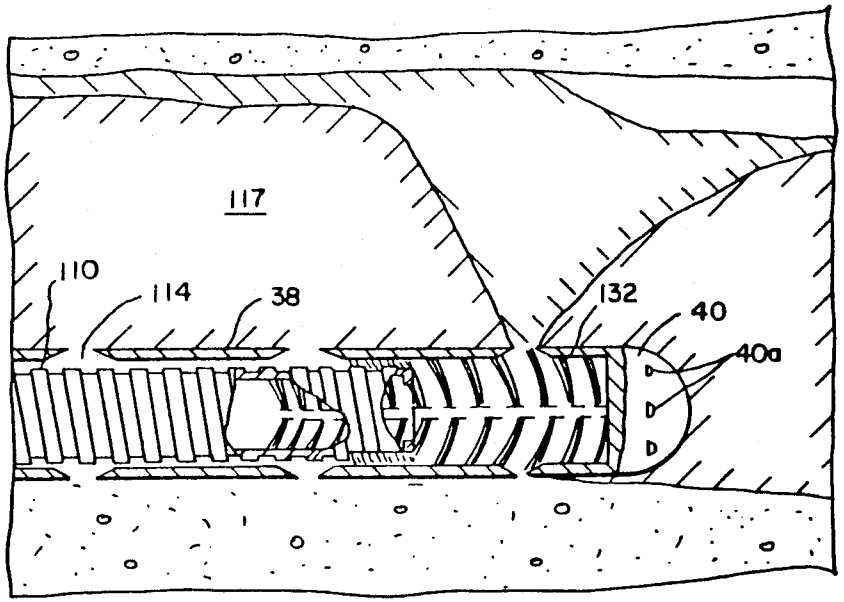
FIG. 6 is a side view partially broken away of a radial tube in the formation, a permeable liner and plug filters in the radial tube.

Referring to FIG. 6 the system of Ser. No. 811,572 is illustrated after completion of gravel packing. Specifically, the radial tube 38 is of the same type as illustrated in FIG. 4 with like parts denoting like numbers and with a severed proximal end 38*a*. The system includes a liner 110 of the aforementioned type disposed within the radial tube. Permeable plug filter means 132 and 134 are placed at the proximal and distal ends, respectively, of the radial tube in the manner described above. Pipe cutting device 80 may also be used to sever the portion of liner 110 disposed between device 80 pipe and radial tube 38. Additional gravel pack 136 is placed in a conventional manner using a slotted liner in the well by pumping through the well and the underreamed portion and continuing pumping until the remainder of the annulus is filled.

Figure 7:
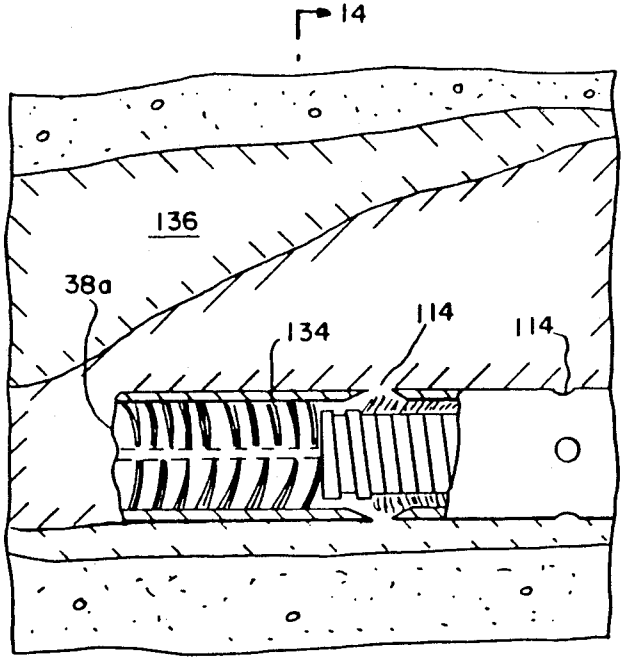
FIG. 7 is a cross-sectional view of FIG. 6 taken along the line 7—7.
Figure 7:
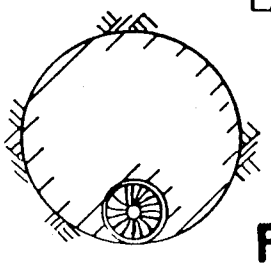

The radial tube of FIGS. 6 and 7 are illustrated as being fully gravel packed and in combination with the conventional well bore is suitable for production. Oil from the surrounding formation flows through radial tube perforations 114 and permeable liner 110 into the lumen of the radial tube and from there into a sump at the well bore for pumping to the surface in accordance with conventional technology. Multiple radials may be placed and disposed in the manner of spokes projecting from an axis.

Figure 8:
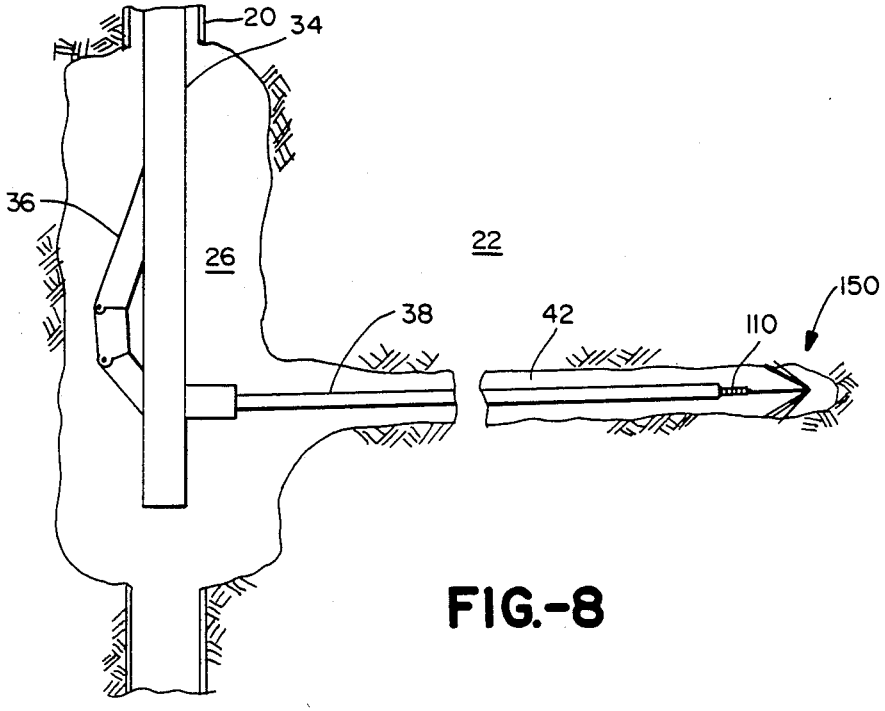
FIGS. 8 and 9 illustrate side elevational views in section of a portion of the drill system with the liner anchored in place, before and after withdrawal of the radial, respectively.

Referring to FIGS. 8–11, a preferred embodiment of the present invention is illustrated. Certain component parts are identical to ones disclosed in FIGS. 1–7, and so like parts will be designated with like numbers. Housing 34 carries whipstock means 36 which is illustrated in FIG. 8 in an erected position. A drill string passes through the whipstock means and projects into the formation as radial tube 38. As illustrated, the hole has been drilled to create annulus 42 between radial tube 38 and the surrounding formation. Furthermore, drillhead 40 (not shown) has been previously severed by the pipe cutting technique described with respect to FIG. 2 and is removed from the proximal end of the radial tube.

Anchor means 150 is attached to the distal end of liner 110. It includes a shaft 152 projecting through the center of disk 154, and secured thereto. Shaft 152 extends the full length of liner 110 as described below. Anchor strands (e.g. six) 156 are attached to a solid circular disk 160 which is welded to the forward end of shaft 152. Annular seal 160*a*, of the chevron-type, mounted t the outer periphery of disk 160, is in sliding sealing engagement with the interior wall of radial tube 38. When fluid pressure is applied against the back side of disk 160 from the surface, it propels anchor means 150 forward until it exits the distal end of radial tube 38 after drillhead 40 has been severed. Strands 156 have a memory which causes them to project radially outwardly at the mating point between shaft 152 and disk 160.

Spacer means is provided for propelling liner 110 a further distance to approximately the distal end of radial tube 38 so that strands 156 are free of the radial constraint provided by the radial tube and can project into the formation to provide an anchor. As illustrated, such spacer means comprises disk 154 and annular sliding seal 154*a*, also preferable of the chevron-type. Without such spacer means, after disk 160 clears radial tube 38, the propulsion force would cease. Liner 110 includes sand filter means (not shown) at its distal end in the form of a metal screen or plug filter.

In one embodiment, the rearward end of liner 110 is initially constrained by power cable 170 which limits the speed of travel of liner 110. Power cable 170 includes external insulation and an internal axial conductor.

Means 172 is provided for detachable coupling the rearward side of liner 110 to cable 170. Means 172 includes a conical filter portion 174 connected to a thin wire 176, e.g. piano wire, which, in turn, is connected to insulated power cable 170 through coupling 178. Thermal insulation in the form of nylon sheath 180 is placed around wire 176. When liner 110 has reached its full projection through the radial tube and into formation, the connection to cable 170 then is detached by passing an electric current through the power cable to heat and melt wire 176. Then the power cable is removed leaving the liner in place.

At this stage, the radial tube also is removed from the surface. One system for accomplishing this is to place a convention screw-threaded spear into the upper end of radial tube 38 and screwing it in from the well surface, forming a strong coupling with it. The spear is pulled from the well surface so that the radial tube is removed from the formation through the whipstock housing and all the way to the surface.

To project multiple radially spaced liners into the formation, whipstock means 36 is collapsed and reused in the manner described above. Before doing so, the proximal end of liner 110 is severed, suitably by using the pipe cutting device of FIG. 2. Then a spear of the aforementioned type can be lowered through the casing into the rearward end of the liner and the remainder of the liner is removed from the surface. This leaves the liner in place disattached from the vertical portion of the production apparatus. Prior to severing, it is preferable to place plug filters (e.g. of the bottle brush type) to keep sand out at the distal end of the liner and at the opposite severed end in the manner described with regard to FIG. 6.

In the stage illustrated in FIG. 8, liner 110 is pushed in a forward direction after drillhead 40 has been severed and pushed out into the formation. Anchor means 150 has projected a sufficient distance into the formation to anchor or retain the liner against forces applied when the radial tube 38 is withdrawn. As illustrated in FIG. 8, the radial tube has been pulled a short distance towards the surface to expose a small portion of liner 110.

Figure 9:
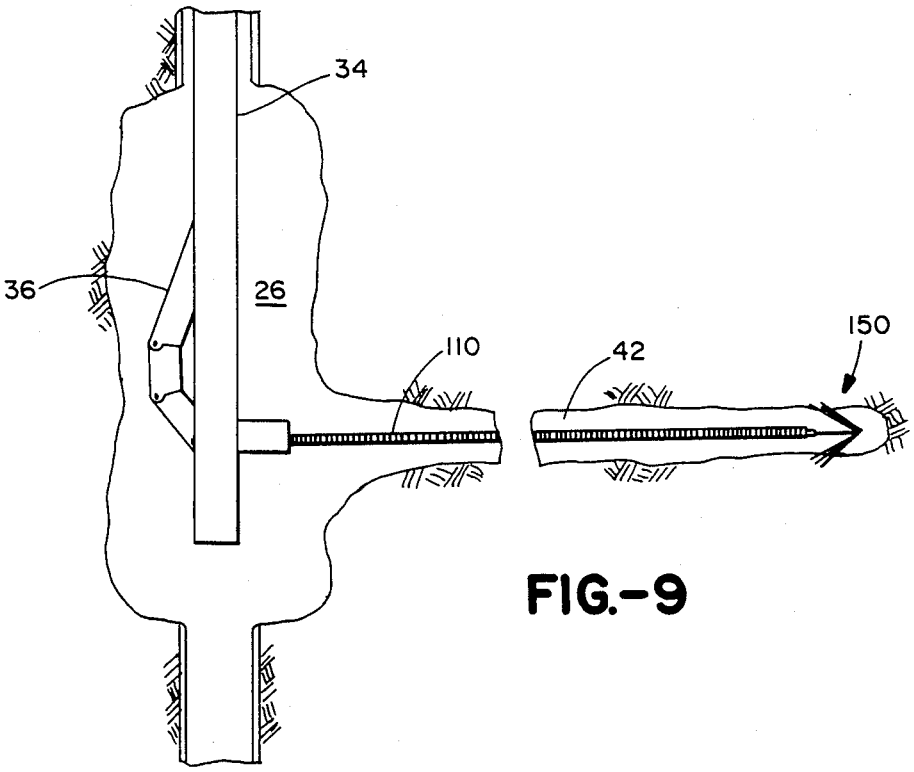
Figure 10:
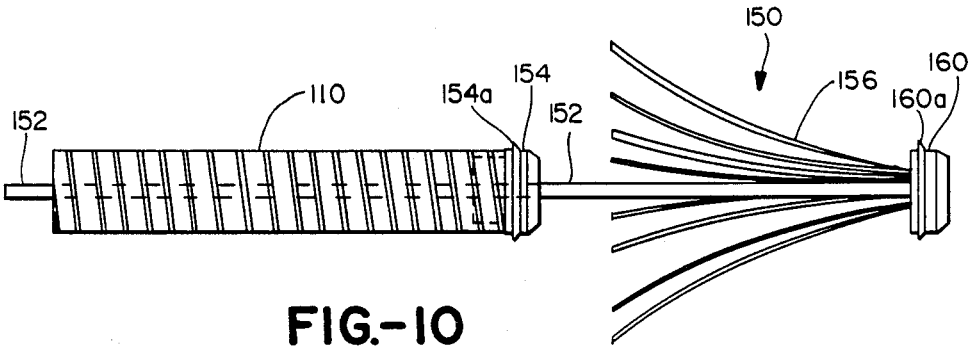
FIG. 10 is a side view of the distal end of the liner and anchor.

Referring to FIG. 9, radial tube 38 has been completely removed from the formation leaving liner 110 anchored in place.

As described above, liner 110 may be placed in position after radial tube 38 reaches its full extension in the formation. This can be done by hydraulic forces applied against a flexible piston placed on its nose, as described, or some other means.

Liner 110 and radial tube 38 may be placed into the formation simultaneously by detachably coupling the distal end of liner 110 to the distal end of the radial tube. In this instance, the pipe cutter passes within the liner to a position behind the, drillhead to sever it so that the liner pushes the drillhead out of the way and anchors into the formation to permit retraction of radial pipe 38 from the system. Alternatively, liner 110 may disengage the drillhead when it reaches the distal end of the radial tube. One technique would be to include an explosive charge at the distal end of anchor means 150 which removes the drillhead and permits the liner to project through the thus-severed opening of the radial tube.

It has been found that flexible conventional metal (e.g. stainless steel) conduit used to sheath electric cable is uniquely suited for use as a liner in the present invention. One such conduit is conventionally termed BX electrical conduit. In general terms, the liner forms an opening of at least one elongated slot and, more specifically, at least one continuous spiral slot.

Figure 12A:
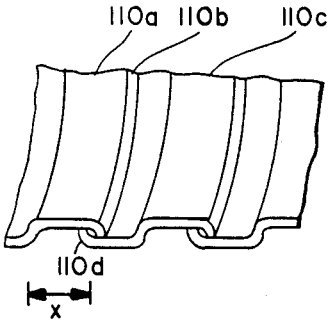
FIGS. 12*a–c* are sections illustrating different embodiments of the liner construction.
Figure 12B:
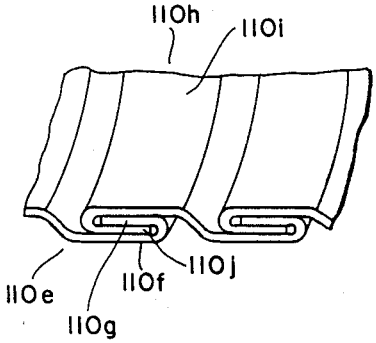
Figure 11:
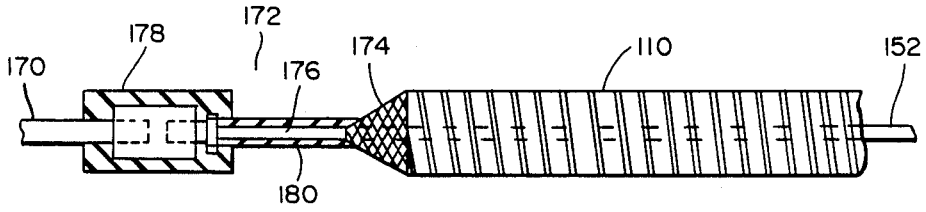
FIG. 11 is a side view, partially in section of the proximal end of the liner and its coupling to a power cable.
Figure 12C:
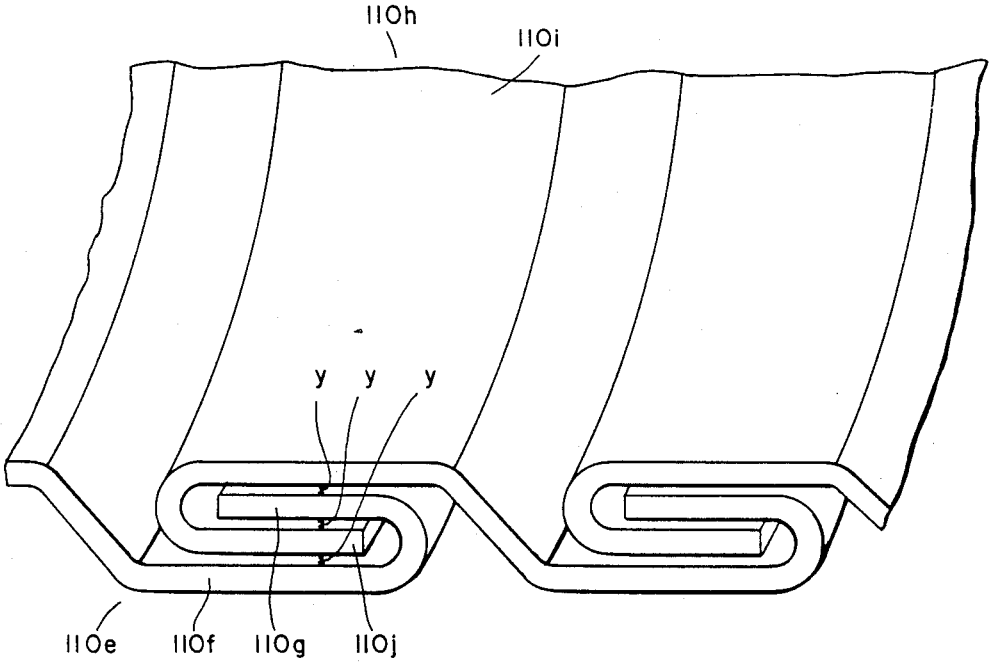

Referring to FIGS. 12*a–c,* various forms of suitable electrical conduit are illustrated. They all include a flexible metal tube formed of two continuous interlocking spiral strips. The slots form openings between the linked portions of the strips.

Referring specifically to FIG. 12*a,* liner 110 includes a continuous spiral strip 110*a* with a downwardly projecting shoulder 110*b* at the interlink with adjacent strip 110*c* which also includes an upwardly or oppositely projecting shoulder 110*d* in registry with shoulder 110*b* at the interlink with strip 110*a*. Such conduit is sold under the designation Type MP by Anamet, Inc.

FIG. 12*b* illustrates another embodiment of a flexible liner with somewhat different interlinking portions that loop around each other but which function in the same general manner permitting relative movement at the interlink for expansion and contraction of the liner length. Corresponding parts will be designated with corresponding numbers for FIGS. 12*b* and 12*c*. FIG. 12*c* is an expanded view of FIG. 12*b*. Such conduit is sold under the designation Type UI by Anamet, Inc.

Referring to FIGS. 12*b* and 12*c*, the liner includes a strip 110*e* with a lower flat portion 110*f* which turns 180 degrees to an upper flat portion 110*g*. Interlinked strip 110*h* includes an upper flat portion 110*i* which turns 180 degrees to a lower flat portion 110*j*.

A distance defining a maximum longitudinal distance of play is designated by arrow X at each interlink of the strip. Adjacent interlink portions are free to move relative to each other a distance approximately equal to X, permitting expansion and contraction of the liner length as compressive and tensile forces are applied to the liner. In the illustrated embodiments of FIGS. 12*a–*12*c,* the liner is in its fully expanded length position which is its normal resting position. In this position, there is maximum flexibility of the liner. When the liner is compressed so that distance X is reduced, flexibility of the liner decreases.

Another distance, designated Y, defines the opening between the adjacent strips of the liner for oil transport and particle filtering. Referring to FIG. 12*c,* that opening Y is the vertical distance between the horizontal elongated adjacent strip portions at the interlink. In FIG. 12*c*, there are three approximately equal Y distances.

Various dimensions and types of liners may be employed in accordance with the present invention, preferably in the form used in the above electrical conduits. Suitable conduits have distances Y between 100 and 2500 microns, preferably about 250 to 500 microns. It has been found that a smaller conduit, e.g. a distance Y of 100–500 microns, produces oil with least resistance while being the most effective in control of passage of particles.

Common properties of the flexible liner of the foregoing types and other similar types suitable for sheathing of electrical cable or hydraulic hose are that at the interlink there is a sufficient opening (distance Y) to permit the flow of oil but insufficient to permit particles of gravel pack or formation to pass into the liner. Unexpectedly, it has been found that the liner does not clog with such particles. It is believed that one contributing factor to this is the flexibility of the liner which expands and contracts linearly within the formation to dislodge particles along its length.

If any particle clogging of the liner occurs, the particles may be removed by surging pressure in the well which causes relative movement of adjacent strips, or play in distance Y, to work the particles free. Such surging may be performed by flowing a fluid, e.g. water or steam, through the well into the formation.

Another feature of this type of liner is that it can be twisted to compress it radially and untwisted to expand it radially. Thus, it may be passed downwardly into the formation in a twisted or radially compressed form and expanded in the formation by untwisting.

Another unique feature of the liner is that it can function without gravel packing. Thus, after placement into the formation as illustrated schematically in FIG. 9, it is capable of serving as a production radial without gravel packing. It is preferable to place filter means, not shown, at the proximal end of liner 110 which permits passage of oil from the formation through the liner back to the drill string while excluding particles the size of gravel pack or the formation. One such filter means is a permeable plug filter 134 illustrated in FIG. 6. Instead of being placed in a radial tube 38, the plug filter means would be placed within liner 110. If the proximal end is severed to collapse and permit removal of whipstock means 36, plug filters are placed at both ends of liner 110 by analogy to FIG. 6.

In the above technique, production apparatus is formed for withdrawing oil from an oil bearing formation which includes housing 110, flexible, elongated hollow tube liner 38 extending from the well casing into the formation, with the interior of the liner and well casing being in fluid communication. The liner is in direct contact with particles in the formation along its length free of external conduit (i.e. with radial tube 38 removed). The liner includes openings of a size and character for passing oil from the formation while substantially blocking passage into the liner of particles from the formation.

While the present system has been described with respect to a method in which a liner is placed within a radial tube used for drilling, it should be understood that any technique which places liner 110 into the formation as a production radial without surrounding piping between it and the formation encompassed by the present invention. Also, although the preferred embodiment is the placement of a radial, the system can also be used with a liner placed into the formation without turning through a whipstock, e.g. in a horizontal or vertical elevation.

Referring to FIGS. 13*a–f,* a number of alternatives of gravel packing are illustrated for those applications in which gravel packing is desirable. In one embodiment, after placement of the liner and withdrawal of the radial tube, gravel pack is passed through the liner and out its distal end and back towards the casing to form a gravel pack jacket. This embodiment is illustrated sequentially in FIGS. 13*a–c.* Prior to this mode of gravel packing the distal end of liner 110 is severed and removed to leave an unobstructed passageway. However, as illustrated, typically only a partial jacket is formed due to a pressure drop. Then, plug filters are placed at both ends of liner 110 as described above and the distal end is severed.

Figure 13A:
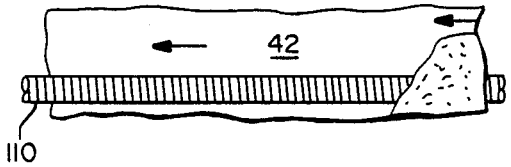
FIGS. 13*a–f* are schematic representations of the liner in the formation illustrating various gravel packing steps.
Figure 13B:
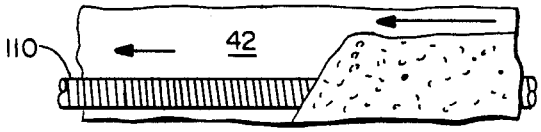
Figure 13C:
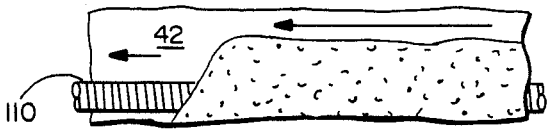
Figure 13D:
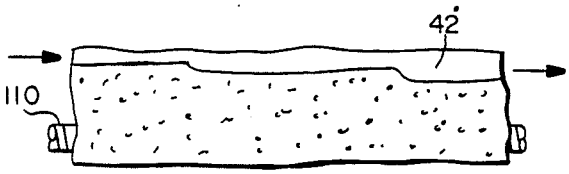
Figure 13E:
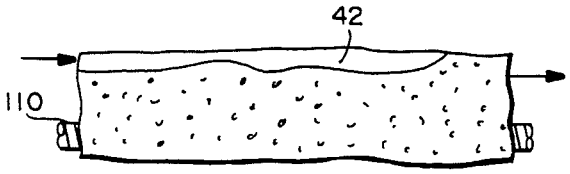
Figure 13F:
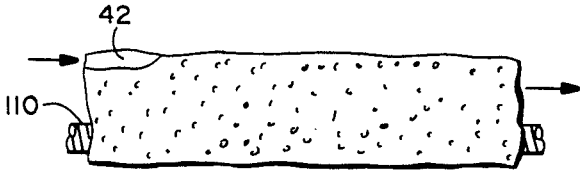

Referring to FIGS. 13*d–f,* the partial gravel pack of FIGS. 13*a–c* is completed by passing gravel from the casing and towards the distal end of the liner in a conventional manner.

In another embodiment, not shown, partial gravel packing may be accomplished by flowing the slurry out radial tube 38 and back toward the well as described above. Then the radial tube is withdrawn. The pack should be loose enough so that the friction with it is not so great as to prevent withdrawal.

What is claimed is:

1. In a method of forming a production apparatus for withdrawing oil from an oil bearing underground formation through a well casing in the formation, the steps of (a) passing a hollow radial tube through a housing in a well casing to the formation and drilling the radial tube to project into the formation, said radial tube and formation defining an annulus therebetween which is relatively permeable or free of formation, (b) passing a flexible, elongated, hollow tube liner through the casing and radial tube and out into the formation, and (c) withdrawing the radial tube from the formation through the casing, leaving the liner in the formation, said liner including openings of a size and character to pass oil from said formation into said liner but substantially block passage of formation particles.

2. The method of claim 1 in which radial tube and liner are passed simultaneously into the formation.

3. The method of claim 1 in which said liner is passed by propulsion through the radial tube after said radial tube is in the formation.

4. The method of claim 3 in which the adjacent interlinked portions are free to move relative to each other permitting expansive and contraction of the liner length.

5. The method of claim 4 in which the metal tube is twisted to compress it radially during step (b) and is untwisted to expand it radially after step (c).

6. The method of claim 4 in which said liner comprises conventional flexible metal conduit used to sheath electrical cable.

7. The method of claim 1 in which said liner openings comprise at least one elongated slot.

8. The method of claim 1 in which said liner comprises a flexible metal tube formed of two adjacent continuous interlinking spiral strips and said slot comprises openings between the interlinked portions of the strip.

9. The method of claim 1 in which said radial tube includes a drillhead at its forward end during drilling, said method further comprising severing said drill head from the radial tube prior to passing the liner into the formation.

10. The method of claim 1 further comprising the step of anchoring the distal end of the liner in the formation prior to withdrawing the radial tube.

11. The method of claim 1 in which, after step (c), a slurry of particles of a size capable of forming a gravel pack is passed from the well casing into the annulus formation to form a jacket of gravel pack particles around the liner.

12. The method of claim 1 in which, after step (c) particles of a size or capable of forming a gravel pack are passed through the liner out its distal end and back along it towards the housing to form a partial jacket of gravel pack particles around the liner.

13. The method of claim 12 in which, after forming the partial jacket, slurry is passed from the housing toward the distal end of the liner to substantially complete the gravel pack.

14. The method of claim 12 in which after step (b) the distal end of the radial tube is withdrawn to a position adjacent the housing and said slurry is passed through the radial tube into the formation.

15. The method of claim 1 in which no gravel pack is placed in said annulus.

16. The method of claim 1 further comprising the step of inserting particle filter means in the distal end of the liner.

17. Production apparatus suitable for withdrawing oil from an oil-bearing formation, said apparatus comprising a well casing, housing within said well casing, a perforated hollow production radial tube extending from the well casing into the formation, the interior said radial tube and well casing being in fluid communication, and a hollow tube liner disposed within said radial tube adjacent to said redial tube perforations for passing oil from said formation into said radial tube while substantially blocking passage into the radial tube of particles of the size of gravel packing.

18. Production apparatus for withdrawing oil from an oil bearing underground formation, said apparatus comprising a well casing, a housing within the well casing, a flexible, elongated, hollow tube liner extending from the housing into the formation, the interior of said liner and housing being in fluid communication, said liner being in direct contact with particles in the formation along its length free of an external conduit, said liner including openings of a size and character for passing oil from said formation while substantially blocking passage into the liner of particles from the formation, said liner being substantially free of gravel packing external to and internal of the liner.

19. Production apparatus for withdrawing oil from an oil bearing underground formation, said apparatus comprising a well casing, a housing within well casing, a flexible, elongated, hollow tube liner extending from the housing into the formation, the interior of said liner and housing being in fluid communication, said liner being in direct contact with particles in the formation along its length free of an external conduit, said liner including openings of a size and character for passing oil from said formation while substantially blocking passage into the liner of particles from the formation, said liner comprising a flexible tube formed of adjacent interlinking spiral strips and slots comprises openings between the interlinked portions of the strips.

20. The production apparatus of claim 19 in which said liner openings comprise at least one elongated slot.

21. The production apparatus of claim 19 in which said liner comprises a flexible metal tube formed of adjacent interlinking spiral strips and said slots comprises openings between the interlinked portions of the strips.

22. The production apparatus of claim 19 in which the adjacent interlinked portions are free to move relative to each other permitting expansion and contraction of the liner length.

23. The production apparatus of claim 19 in which said liner comprises conventional flexible metal conduit used to sheath electrical cable.

24. The production apparatus of claim 19 together with a jacket of gravel packing between said liner and surrounding formation.

25. The production apparatus of claim 19 further comprising filter means at the distal end of said liner.

26. The production apparatus of claim 19 in which said well bore is substantially vertical and said liner is substantially horizontal.

27. The production apparatus of claim 26 in which the proximal end of said horizontal liner is spaced from and unattached to the vertical portion of said production apparatus.

28. The production apparatus of claim 26 together with at least a second, radially spaced, flexible, elongate, hollow tube liner extending into the formation in a different radial direction than said first liner.

29. Production apparatus for withdrawing oil from an oil bearing underground formation, said apparatus comprising a well casing, a housing within the well casing, a flexible, elongated, hollow tube liner extending from the housing into the formation, the interior of said liner and housing being in fluid communication, said liner being in direct contact with particles in the formation along its length free of an external conduit, said liner including openings of a size and character for passing oil from said formation while substantially blocking passage into the liner of particles from the formation, and anchor means disposed at the distal end of the liner extending into the formation and serving to immobilize the liner against pulling forces from along its length.

* * * * *

UNITED STATES PATENT AND TRADEMARK OFFICE

CERTIFICATE OF CORRECTION

PATENT NO. : 4,872,509

DATED : October 10, 1989

INVENTOR(S) : Dickinson et al.

It is certified that error appears in the above—identified patent and that said Letters Patent is hereby corrected as shown below:

Column 12, line 19 (Claim 17), delete "redial" and insert --radial--.

Signed and Sealed this

Thirtieth Day of October, 1990

*Attest:*

HARRY F. MANBECK, JR.

*Attesting Officer*

*Commissioner of Patents and Trademarks*